US012805576B2

(12) United States Patent
Novak, III et al.

(10) Patent No.: US 12,805,576 B2
(45) Date of Patent: Nov. 24, 2026

(54) AEROSOL PROVISION SYSTEM WITH A NON-CONSUMABLE ARTICLE FOR CHANGING A DEVICE SETTING

(71) Applicant: RAI Strategic Holdings, Inc., Winston-Salem, NC (US)

(72) Inventors: Charles Jacob Novak, III, Winston-Salem, NC (US); Sean A. Daugherty, Yadkinville, NC (US)

(73) Assignee: RAI Strategic Holdings, Inc., Winston-Salem, NC (US)

( * ) Notice: Subject to any disclaimer, the term of this patent is extended or adjusted under 35 U.S.C. 154(b) by 499 days.

(21) Appl. No.: 17/644,517

(22) Filed: Dec. 15, 2021

(65) Prior Publication Data

US 2023/0180849 A1 Jun. 15, 2023

(51) Int. Cl.

| | |
|---|---|
| ***A24F 40/53*** | (2020.01) |
| ***A24F 40/42*** | (2020.01) |
| ***A24F 40/51*** | (2020.01) |
| ***A24F 40/60*** | (2020.01) |

(52) U.S. Cl.

CPC ..... *A24F 40/53* (2020.01); *A24F 40/42* (2020.01); *A24F 40/51* (2020.01); *A24F 40/60* (2020.01)

(58) Field of Classification Search

CPC ..... A24F 40/53; A24F 40/42; A24F 40/51; A24F 40/60

See application file for complete search history.

(56) References Cited

U.S. PATENT DOCUMENTS

| | | | |
|---|---|---|---|
| 2,057,353 | A | 10/1936 | Whittemore, Jr. |
| 2,104,266 | A | 1/1938 | McCormick |
| 3,200,819 | A | 8/1965 | Gilbert |
| 4,922,901 | A | 5/1990 | Brooks et al. |
| 5,060,671 | A | 10/1991 | Counts et al. |

(Continued)

FOREIGN PATENT DOCUMENTS

| | | |
|---|---|---|
| CN | 1541577 | 11/2004 |
| CN | 2719043 | 8/2005 |

(Continued)

*Primary Examiner* — Michael H. Wilson
*Assistant Examiner* — Jennifer A Kessie
(74) *Attorney, Agent, or Firm* — Womble Bond Dickinson (US) LLP

(57) ABSTRACT

An aerosol provision device is provided that includes a coupler or receptacle, and circuitry. The coupler or receptacle is structured to separately and individually engage articles of different types including consumables with aerosol-generating material, and non-consumables without aerosol-generating material. The non-consumables have target electrical resistances associated with respective settings of the aerosol provision device. The circuitry includes processing circuitry configured to detect engagement of an article with the coupler or receptacle and thereby the aerosol provision device. The processing circuitry is configured to measure an electrical resistance of the article that indicates the article is a non-consumable. And the processing circuitry is configured to identify one of the target electrical resistances that most closely matches the electrical resistance of the article, identify a setting of the respective settings that is associated with the one of the target electrical resistances, and change a value of the setting.

20 Claims, 8 Drawing Sheets

(56) References Cited

U.S. PATENT DOCUMENTS

| | | | |
|---|---|---|---|
| 5,093,894 | A | 3/1992 | Deevi et al. |
| 5,894,841 | A | 4/1999 | Voges |
| 6,125,853 | A | 10/2000 | Susa et al. |
| 6,155,268 | A | 12/2000 | Takeuchi |
| 7,117,867 | B2 | 10/2006 | Cox et al. |
| 7,832,410 | B2 | 11/2010 | Hon |
| 8,314,591 | B2 | 11/2012 | Terry et al. |
| 8,365,742 | B2 | 2/2013 | Hon |
| 8,499,766 | B1 | 8/2013 | Newton |
| 8,528,569 | B1 | 9/2013 | Newton |
| 8,689,804 | B2 | 4/2014 | Fernando et al. |
| 8,833,364 | B2 | 9/2014 | Buchberger |
| 9,220,304 | B2 | 12/2015 | Greim |
| 9,462,831 | B2 | 10/2016 | Liu |
| 9,597,466 | B2 | 3/2017 | Henry, Jr. et al. |
| 9,877,508 | B2 | 1/2018 | Kane |
| 10,015,990 | B2 | 7/2018 | Mironov |
| 10,028,537 | B1 | 7/2018 | Hawes et al. |
| 10,058,125 | B2 | 8/2018 | Worm et al. |
| 10,080,851 | B2 | 9/2018 | Davidson et al. |
| 10,085,481 | B2 | 10/2018 | Verleur et al. |
| 10,092,037 | B2 | 10/2018 | Tucker et al. |
| 10,104,913 | B2 | 10/2018 | Lau et al. |
| 10,117,463 | B2 | 11/2018 | Thomas |
| 10,117,467 | B2 | 11/2018 | Hawes et al. |
| 2005/0016550 | A1 | 1/2005 | Katase |
| 2005/0268000 | A1* | 12/2005 | Carlson ..... G06F 13/4081 710/15 |
| 2006/0196518 | A1 | 9/2006 | Hon |
| 2008/0092912 | A1 | 4/2008 | Robinson et al. |
| 2009/0095311 | A1 | 4/2009 | Hon |
| 2009/0126745 | A1 | 5/2009 | Hon |
| 2009/0151717 | A1 | 6/2009 | Bowen et al. |
| 2009/0188490 | A1 | 7/2009 | Hon |
| 2009/0272379 | A1 | 11/2009 | Thorens et al. |
| 2009/0320863 | A1 | 12/2009 | Fernando et al. |
| 2011/0094523 | A1 | 4/2011 | Thorens et al. |
| 2011/0126848 | A1 | 6/2011 | Zuber et al. |
| 2011/0155718 | A1 | 6/2011 | Greim et al. |
| 2011/0168194 | A1 | 7/2011 | Hon |
| 2011/0265806 | A1 | 11/2011 | Alarcon et al. |
| 2013/0037041 | A1 | 2/2013 | Worm et al. |
| 2013/0042865 | A1 | 2/2013 | Monsees et al. |
| 2013/0306084 | A1 | 11/2013 | Flick |
| 2013/0319435 | A1 | 12/2013 | Flick |
| 2014/0000638 | A1 | 1/2014 | Sebastian et al. |
| 2014/0096781 | A1 | 4/2014 | Sears et al. |
| 2014/0096782 | A1 | 4/2014 | Ampolini et al. |
| 2014/0253144 | A1 | 9/2014 | Novak et al. |
| 2014/0261408 | A1 | 9/2014 | DePiano et al. |
| 2014/0261486 | A1 | 9/2014 | Potter et al. |
| 2014/0261487 | A1 | 9/2014 | Chapman et al. |
| 2014/0366898 | A1 | 12/2014 | Monsees et al. |
| 2015/0020832 | A1 | 1/2015 | Greim et al. |
| 2015/0150308 | A1 | 6/2015 | Monsees et al. |
| 2015/0164142 | A1 | 6/2015 | Li et al. |
| 2015/0208729 | A1 | 7/2015 | Monsees et al. |
| 2015/0313287 | A1 | 11/2015 | Verleur et al. |
| 2017/0027226 | A1 | 2/2017 | Mironov et al. |
| 2017/0071256 | A1 | 3/2017 | Verleur et al. |
| 2017/0095005 | A1 | 4/2017 | Monsees et al. |
| 2017/0135404 | A1 | 5/2017 | Reevell |
| 2017/0135405 | A1 | 5/2017 | Reevell |
| 2017/0143042 | A1 | 5/2017 | Batista et al. |
| 2017/0215485 | A1 | 8/2017 | Zitzke |
| 2017/0231281 | A1 | 8/2017 | Hatton et al. |
| 2017/0231282 | A1 | 8/2017 | Hatton et al. |
| 2017/0325289 | A1 | 11/2017 | Liu |
| 2017/0340011 | A1 | 11/2017 | Batista |
| 2017/0340012 | A1 | 11/2017 | Mironov et al. |
| 2017/0347711 | A1 | 12/2017 | Litten et al. |
| 2017/0347712 | A1 | 12/2017 | Singh |
| 2018/0000157 | A1 | 1/2018 | Batista et al. |
| 2018/0000160 | A1 | 1/2018 | Taschner et al. |
| 2018/0014575 | A1 | 1/2018 | Fursa |
| 2018/0020731 | A1 | 1/2018 | Rasmussen et al. |
| 2018/0020736 | A1 | 1/2018 | Silvestrini |
| 2018/0035717 | A1 | 2/2018 | Batista |
| 2018/0042306 | A1 | 2/2018 | Atkins et al. |
| 2018/0043114 | A1 | 2/2018 | Bowen et al. |
| 2018/0077967 | A1 | 3/2018 | Hatton et al. |
| 2018/0084831 | A1 | 3/2018 | Mironov |
| 2018/0103685 | A1 | 4/2018 | Yener |
| 2018/0132525 | A1 | 5/2018 | Patil et al. |
| 2018/0140019 | A1 | 5/2018 | Guo et al. |
| 2018/0177230 | A1 | 6/2018 | Hawes et al. |
| 2018/0213850 | A1 | 8/2018 | Brinkley et al. |
| 2018/0242643 | A1 | 8/2018 | Silvestrini et al. |
| 2018/0280637 | A1 | 10/2018 | Mayle et al. |
| 2018/0295888 | A1 | 10/2018 | Newcomb et al. |
| 2018/0296777 | A1 | 10/2018 | Terry et al. |
| 2019/0045844 | A1 | 2/2019 | Reevell |
| 2020/0154774 | A1* | 5/2020 | Reevell ..... A24F 40/42 |
| 2021/0007401 | A1 | 1/2021 | Moloney et al. |

FOREIGN PATENT DOCUMENTS

| | | |
|---|---|---|
| CN | 201379072 | 1/2010 |
| CN | 211065031 U | 7/2020 |
| CN | 212088079 U | 12/2020 |
| EP | 1 618 803 | 1/2006 |
| WO | WO 2004/080216 | 9/2004 |
| WO | WO 2005/099494 | 10/2005 |
| WO | WO 2007/131449 | 11/2007 |
| WO | WO 2015/022448 | 2/2015 |
| WO | WO 2016/026811 | 2/2016 |
| WO | WO 2017/051006 | 9/2016 |
| WO | WO 2016/207442 | 5/2017 |
| WO | WO 2018/167166 | 9/2018 |
| WO | WO 2018/202732 | 11/2018 |
| WO | 2019003166 A1 | 1/2019 |

* cited by examiner

AEROSOL PROVISION SYSTEM WITH A NON-CONSUMABLE ARTICLE FOR CHANGING A DEVICE SETTING

TECHNOLOGICAL FIELD

The present disclosure relates to aerosol provision systems such as smoking articles designed to deliver at least one substance to a user.

BACKGROUND

Many aerosol provision systems and in particular non-combustible aerosol provision systems have been proposed through the years as improvements upon, or alternatives to, smoking products that require combusting tobacco for use. These systems are generally designed to deliver at least one substance to a user, such as to satisfy a particular "consumer moment." To this end, the substance may include constituents that impart a physiological effect on the user, a sensorial effect on the user, or both. The substance may be generally present in an aerosol-generating material that may contain one or more constituents of a range of constituents, such as active substances, flavors, aerosol-former materials and other functional materials like fillers.

Aerosol provision systems include, for example, vapor products commonly known as "electronic cigarettes," "e-cigarettes" or electronic nicotine delivery systems (ENDS), as well as heat-not-burn products including tobacco heating products (THPs) and carbon-tipped tobacco heating products (CTHPs). Many of these products take the form of a system including a device and a consumable, and it is the consumable that includes the material from which the substance to be delivered originates. Typically, the device is reusable, and the consumable is single-use (although some consumables are refillable). Therefore, in many cases, the consumable is sold separately from the device, and often in a multipack. Moreover, subsystems and some individual components of devices or consumables may be sourced from specialist manufacturers.

BRIEF SUMMARY

Changing settings of an aerosol provision device with no input user interface traditionally involves manually modifying software and uploading new software to the device. This process is not only time-consuming, but prone to errors. Faulty coding oftentimes is only caught after a device is tested. Example implementations of the present disclosure therefore provide an improved process for changing a setting of an aerosol provision device. Example implementations provide a non-consumable that is similar to a consumable, but that does not include an aerosol-generating material. The non-consumable instead has a target electrical resistance that is associated with a setting. Depending on the target electrical resistance, then, different settings may be toggled or cycled. When a non-consumable is engaged with an aerosol provision device, the aerosol provision device may provide feedback indicating the setting that has been changed. This may not only help with choosing settings up front, but may also allow a user to verify the device's current settings. This feature may give any user the capability to quickly adjust settings at any time depending on their needs.

The present disclosure includes, without limitation, the following example implementations.

Some example implementations provide an aerosol provision system comprising: a non-consumable of a number of non-consumables without aerosol-generating material, the non-consumables having target electrical resistances associated with respective settings of the aerosol provision device; and aerosol provision device structured to separately and individually engage articles of different types including consumables with aerosol-generating material, and the non-consumables, the aerosol provision device configured to at least: detect engagement of an article with the aerosol provision device; and automatically as a direct result of the engagement, measure an electrical resistance of the article that indicates the article is the non-consumable; identify one of the target electrical resistances that most closely matches the electrical resistance of the article; identify a setting of the respective settings that is associated with the one of the target electrical resistances; and change a value of the setting.

Some example implementations provide an aerosol provision device comprising: one or more of a coupler or a receptacle structured to separately and individually engage articles of different types including consumables with aerosol-generating material, and non-consumables without aerosol-generating material, the non-consumables having target electrical resistances associated with respective settings of the aerosol provision device; and circuitry that includes processing circuitry configured to at least: detect engagement of an article with the coupler or receptacle and thereby the aerosol provision device; and automatically as a direct result of the engagement, measure an electrical resistance of the article that indicates the article is a non-consumable; identify one of the target electrical resistances that most closely matches the electrical resistance of the article; identify a setting of the respective settings that is associated with the one of the target electrical resistances; and change a value of the setting.

Some example implementations provide a method of operating an aerosol provision device that includes one or more of a coupler or a receptacle structured to separately and individually engage articles of different types including consumables with aerosol-generating material, and non-consumables without aerosol-generating material, the non-consumables having target electrical resistances associated with respective settings of the aerosol provision device, the method comprising: detecting engagement of an article with the coupler or receptacle and thereby the aerosol provision device; and automatically as a direct result of the engagement, measuring an electrical resistance of the article that indicates the article is a non-consumable; identifying one of the target electrical resistances that most closely matches the electrical resistance of the article; identifying a setting of the respective settings that is associated with the one of the target electrical resistances; and changing a value of the setting.

These and other features, aspects, and advantages of the present disclosure will be apparent from a reading of the following detailed description together with the accompanying figures, which are briefly described below. The present disclosure includes any combination of two, three, four or more features or elements set forth in this disclosure, regardless of whether such features or elements are expressly combined or otherwise recited in a specific example implementation described herein. This disclosure is intended to be read holistically such that any separable features or elements of the disclosure, in any of its aspects and example implementations, should be viewed as combinable, unless the context of the disclosure clearly dictates otherwise.

It will therefore be appreciated that this Brief Summary is provided merely for purposes of summarizing some example implementations so as to provide a basic understanding of some aspects of the disclosure. Accordingly, it will be appreciated that the above described example implementations are merely examples and should not be construed to narrow the scope or spirit of the disclosure in any way. Other example implementations, aspects and advantages will become apparent from the following detailed description taken in conjunction with the accompanying figures which illustrate, by way of example, the principles of some described example implementations.

BRIEF DESCRIPTION OF THE FIGURES

Figure 1:
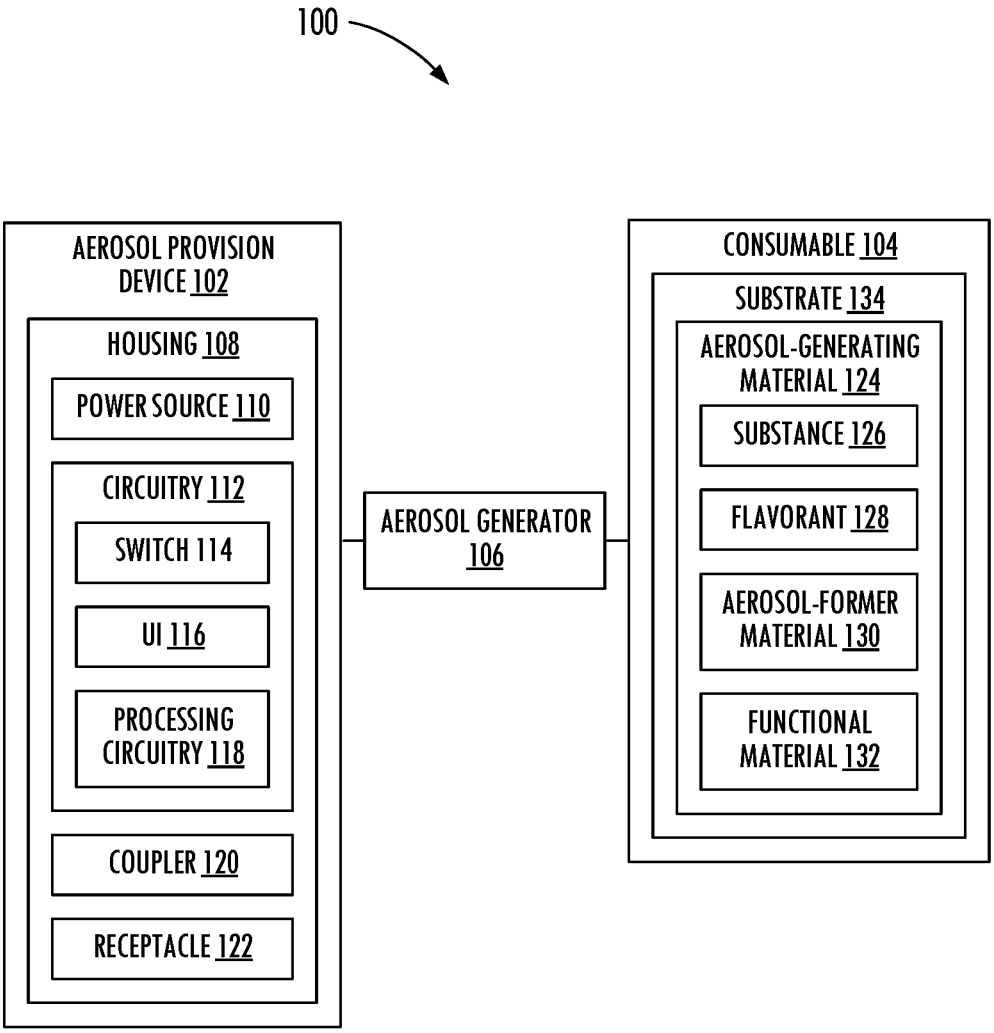
Figure 2:
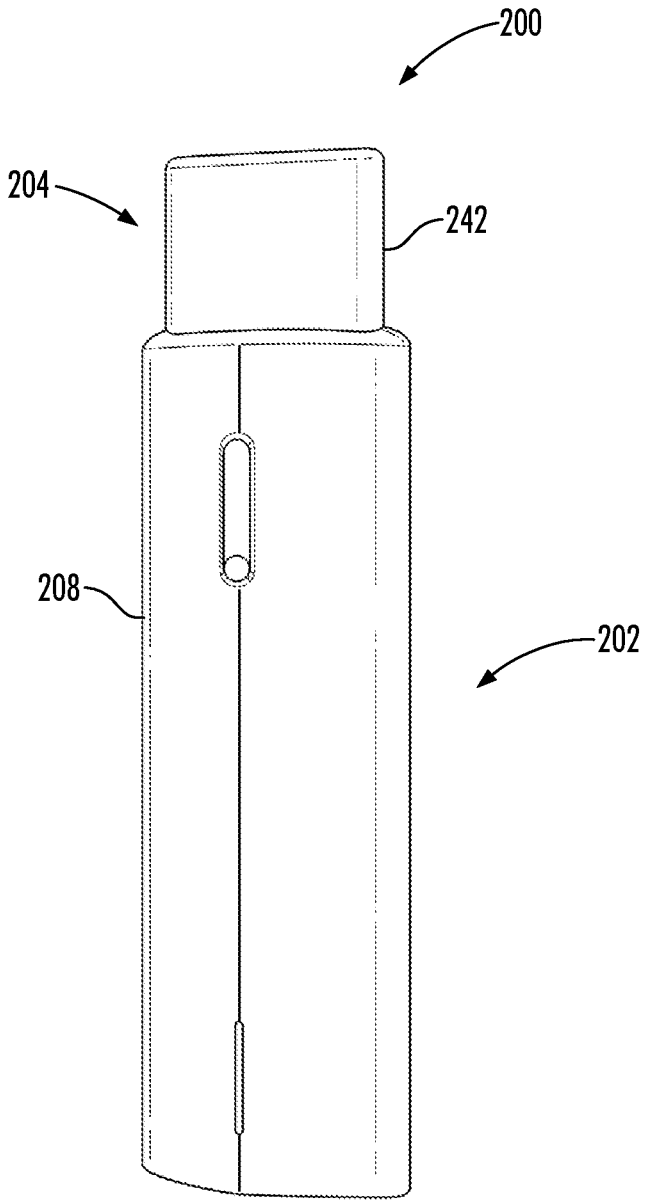
Figure 3:
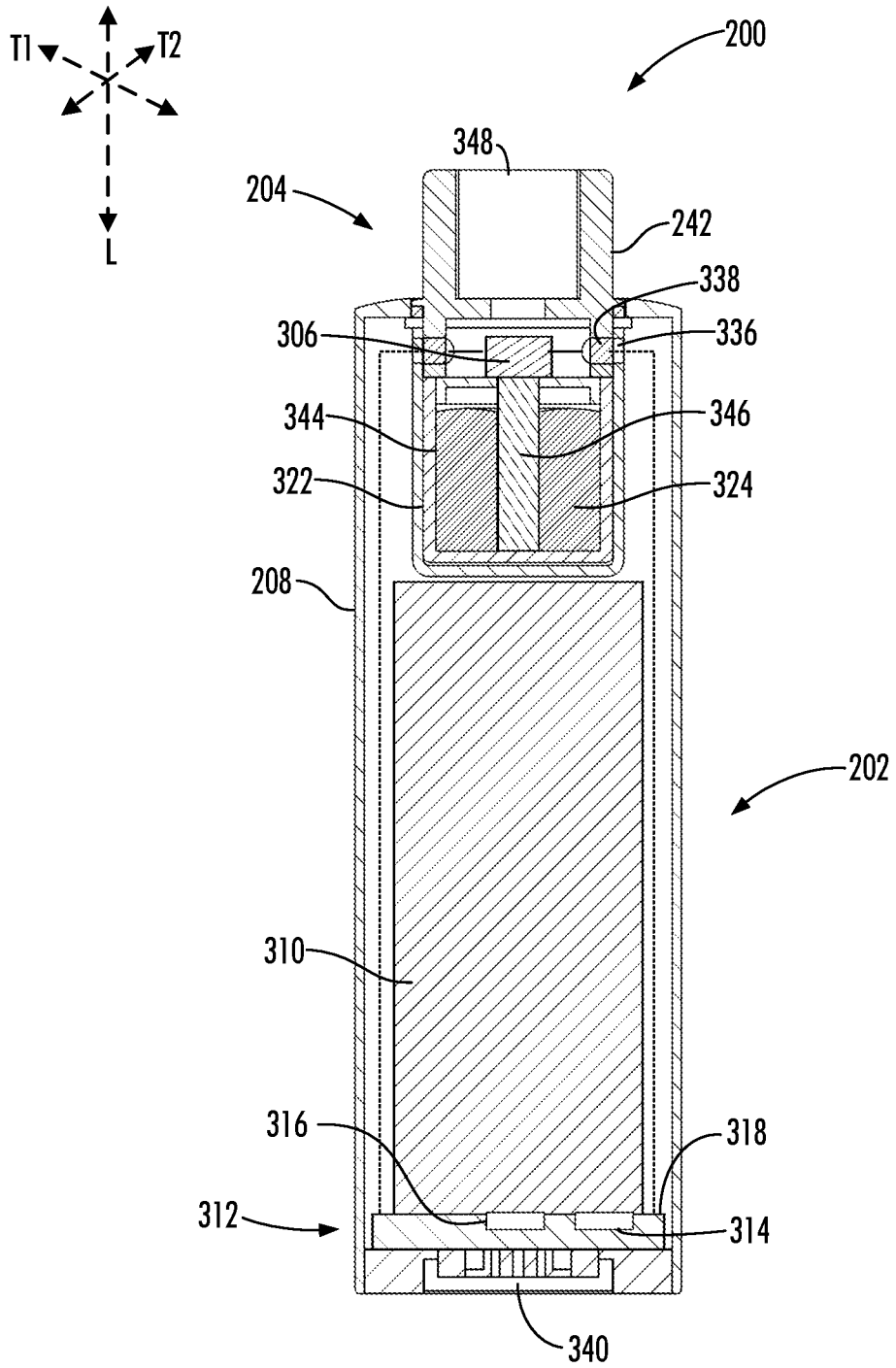
Figure 4:
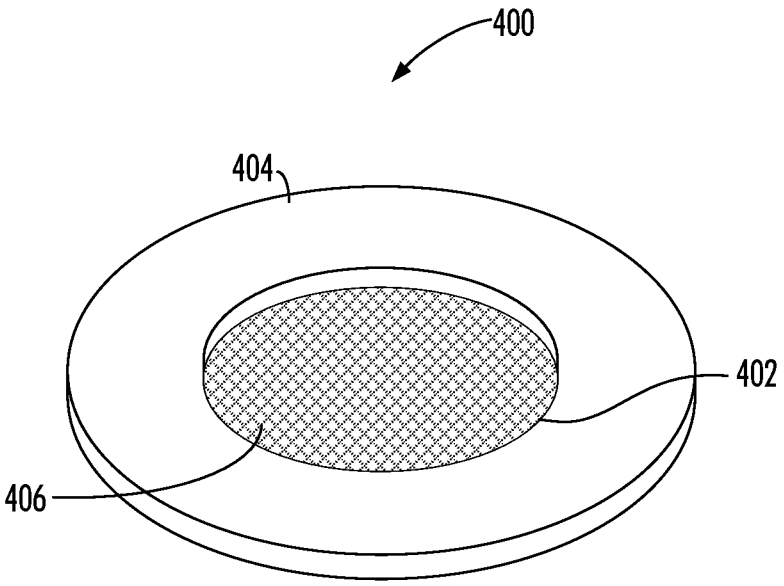
Figure 5:
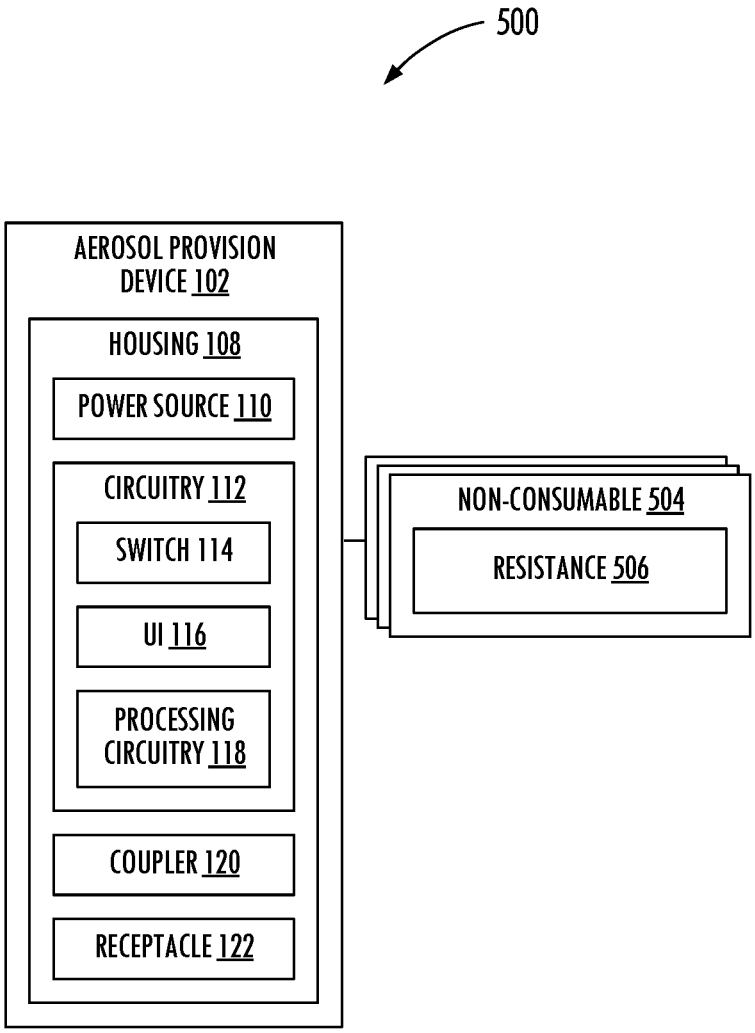
Figure 6:
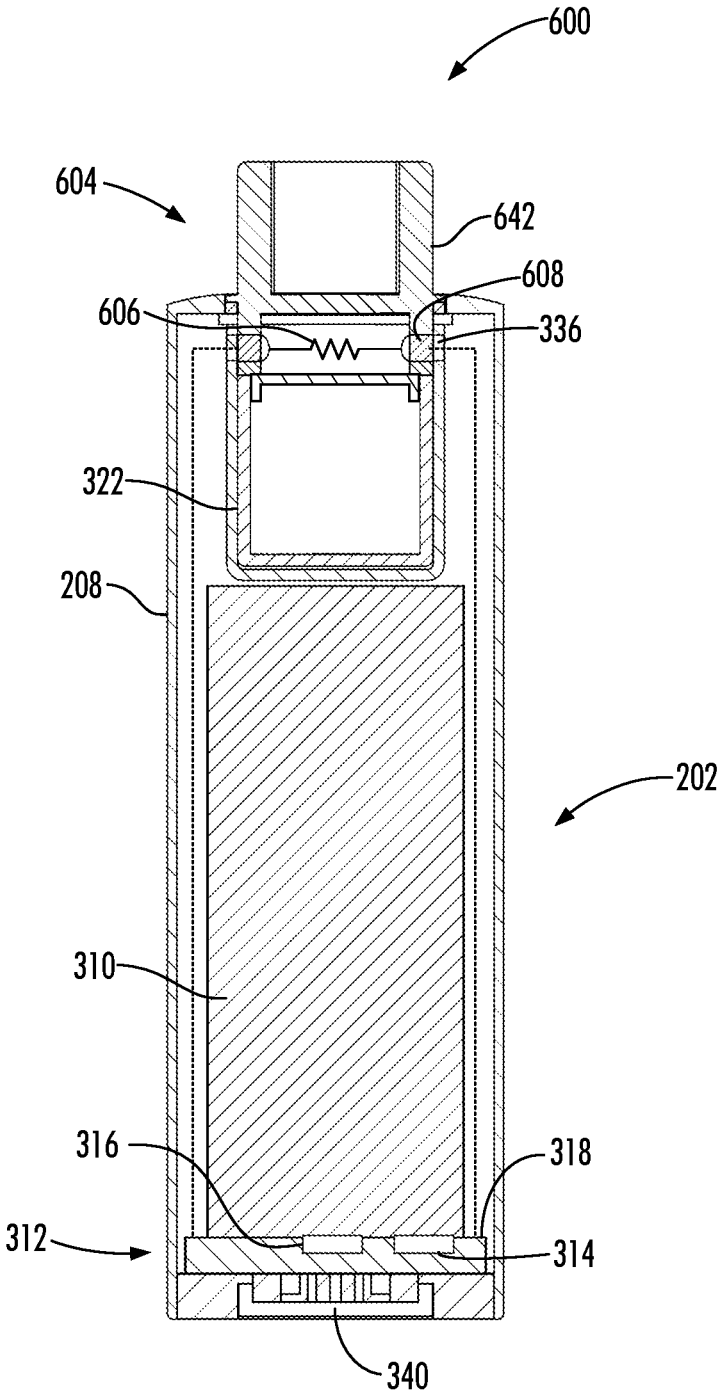

Having thus described aspects of the disclosure in the foregoing general terms, reference will now be made to the accompanying figures, which are not necessarily drawn to scale, and wherein:

FIG. 1 is a block diagram of an aerosol provision system according to some example implementations of the present disclosure;

FIGS. 2 and 3 illustrate an aerosol provision system in the form of a vapor product, according to some example implementations;

FIG. 4 illustrates a nebulizer that may be used to implement an aerosol generator of an aerosol provision system, according to some example implementations;

FIG. 5 is a block diagram of an aerosol provision system including a non-consumable, according to some example implementations of the present disclosure;

FIG. 6 illustrate an aerosol provision system in the form of a vapor product that includes a non-consumable, according to some example implementations;

FIGS. 7A, 7B, 7C, 7D and 7E are flowcharts illustrating various operations in a method of operating an aerosol provision device, according to various example implementations.

DETAILED DESCRIPTION

Some implementations of the present disclosure will now be described more fully hereinafter with reference to the accompanying figures, in which some, but not all implementations of the disclosure are shown. Indeed, various implementations of the disclosure may be embodied in many different forms and should not be construed as limited to the implementations set forth herein; rather, these example implementations are provided so that this disclosure will be thorough and complete, and will fully convey the scope of the disclosure to those skilled in the art. Like reference numerals refer to like elements throughout.

Unless specified otherwise or clear from context, references to first, second or the like should not be construed to imply a particular order. A feature described as being above another feature (unless specified otherwise or clear from context) may instead be below, and vice versa; and similarly, features described as being to the left of another feature else may instead be to the right, and vice versa. Also, while reference may be made herein to quantitative measures, values, geometric relationships or the like, unless otherwise stated, any one or more if not all of these may be absolute or approximate to account for acceptable variations that may occur, such as those due to engineering tolerances or the like.

As used herein, unless specified otherwise or clear from context, the "or" of a set of operands is the "inclusive or" and thereby true if and only if one or more of the operands is true, as opposed to the "exclusive or" which is false when all of the operands are true. Thus, for example, "[A] or [B]" is true if [A] is true, or if [B] is true, or if both [A] and [B] are true. Further, the articles "a" and "an" mean "one or more," unless specified otherwise or clear from context to be directed to a singular form. Furthermore, it should be understood that unless otherwise specified, the terms "data," "content," "digital content," "information," and similar terms may be at times used interchangeably.

Example implementations of the present disclosure are generally directed to delivery systems designed to deliver at least one substance to a user, such as to satisfy a particular "consumer moment." The substance may include constituents that impart a physiological effect on the user, a sensorial effect on the user, or both.

Delivery systems may take many forms. Examples of suitable delivery systems include aerosol provision systems such as powered aerosol provision systems designed to release one or more substances or compounds from an aerosol-generating material without combusting the aerosol-generating material. These aerosol provision systems may at times be referred to as non-combustible aerosol provision systems, aerosol delivery devices or the like, and the aerosol-generating material may be, for example, in the form of a solid, semi-solid, liquid or gel and may or may not contain nicotine.

Examples of suitable aerosol provision systems include vapor products, heat-not-burn products, hybrid products and the like. Vapor products are commonly known as "electronic cigarettes," "e-cigarettes" or electronic nicotine delivery systems (ENDS), although the aerosol-generating material need not include nicotine. Many vapor products are designed to heat a liquid material to generate an aerosol. Other vapor products are designed to break up an aerosol-generating material into an aerosol without heating, or with only secondary heating. Heat-not-burn products include tobacco heating products (THPs) and carbon-tipped tobacco heating products (CTHPs), and many are designed to heat a solid material to generate an aerosol without combusting the material.

Hybrid products use a combination of aerosol-generating materials, one or a plurality of which may be heated. Each of the aerosol-generating materials may be, for example, in the form of a solid, semi-solid, liquid, or gel. Some hybrid products are similar to vapor products except that the aerosol generated from a liquid or gel aerosol-generating material passes through a second material (such as tobacco) to pick up additional constituents before reaching the user. In some example implementations, the hybrid system includes a liquid or gel aerosol-generating material, and a solid aerosol-generating material. The solid aerosol-generating material may include, for example, tobacco or a non-tobacco product.

FIG. 1 is a block diagram of an aerosol provision system 100 according to some example implementations. In various examples, the aerosol provision system may be a vapor product, heat-not-burn product or hybrid product. The aerosol provision system includes one or more of each of a number of components including, for example, an aerosol provision device 102, and a consumable 104 (sometimes referred to as an article) for use with the aerosol provision device. The aerosol provision system also includes an aerosol generator 106. In various implementations, the aerosol generator may be part of the aerosol provision device or the consumable. In other implementations, the aerosol generator may be separate from the aerosol provision device and the consumable, and removably engaged with the aerosol provision device and/or the consumable.

In various examples, the aerosol provision system 100 and its components including the aerosol provision device 102 and the consumable 104 may be reusable or single-use. In some examples, the aerosol provision system including both the aerosol provision device and the consumable may be single use. In some examples, the aerosol provision device may be reusable, and the consumable may be reusable (e.g., refillable) or single use (e.g., replaceable). In yet further examples, the consumable may be both refillable and also replaceable. In examples in which the aerosol generator 106 is part of the aerosol provision device or the consumable, the aerosol generator may be reusable or single-use in the same manner as the aerosol provision device or the consumable.

In some example implementations, the aerosol provision device 102 may include a housing 108 with a power source 110 and circuitry 112. The power source is configured to provide a source of power to the aerosol provision device and thereby the aerosol provision system 100. The power source may be or include, for example, an electric power source such as a non-rechargeable battery or a rechargeable battery, solid-state battery (SSB), lithium-ion battery, supercapacitor, or the like.

The circuitry 112 may be configured to enable one or more functionalities (at times referred to as services) of the aerosol provision device 102 and thereby the aerosol provision system 100. The circuitry includes electronic components, and in some examples one or more of the electronic components may be formed as a circuit board such as a printed circuit board (PCB).

In some examples, the circuitry 112 includes at least one switch 114 that may be directly or indirectly manipulated by a user to activate the aerosol provision device 102 and thereby the aerosol provision system 100. The switch may be or include a pushbutton, touch-sensitive surface or the like that may be operated manually by a user. Additionally or alternatively, the switch may be or include a sensor configured to sense one or more process variables that indicate use of the aerosol provision device or aerosol provision system. One example is a flow sensor, pressure sensor, pressure switch or the like that is configured to detect airflow or a change in pressure caused by airflow when a user draws on the consumable 104.

The switch 114 may provide user interface functionality. In some examples, the circuitry 112 may include a user interface (UI) 116 that is separate from or that is or includes the switch. The UI may include one or more input devices and/or output devices to enable interaction between the user and the aerosol provision device 102. As described above with respect to the switch, examples of suitable input devices include pushbuttons, touch-sensitive surfaces and the like. The one or more output devices generally include devices configured to provide information in a human-perceptible form that may be visual, audible or tactile/haptic. Examples of suitable output devices include light sources such as light-emitting diodes (LEDs), quantum dot-based LEDs and the like. Other examples of suitable output devices include display devices (e.g., electronic visual displays), touchscreens (integrated touch-sensitive surface and display device), loudspeakers, vibration motors and the like.

In some examples, the circuitry 112 includes processing circuitry 118 configured to perform data processing, application execution, or other processing, control or management services according to one or more example implementations. The processing circuitry may include a processor embodied in a variety of forms such as at least one processor core, microprocessor, coprocessor, controller, microcontroller or various other computing or processing devices including one or more integrated circuits such as, for example, an ASIC (application specific integrated circuit), an FPGA (field programmable gate array), some combination thereof, or the like. In some examples, the processing circuitry may include memory coupled to or integrated with the processor, and which may store data, computer program instructions executable by the processor, some combination thereof, or the like.

As also shown, in some examples, the housing 108 and thereby the aerosol provision device 102 may also include a coupler 120 and/or a receptacle 122 structured to engage and hold the consumable 104, and thereby couple the aerosol provision device with the consumable. The coupler may be or include a connector, fastener or the like that is configured to connect with a corresponding coupler of the consumable, such as by a press fit (or interference fit) connection, threaded connection, magnetic connection or the like. The receptacle may be or include a reservoir, tank, container, cavity, receiving chamber or the like that is structured to receive and contain the consumable or at least a portion of the consumable.

The consumable 104 is an article including aerosol-generating material 124 (also referred to as an aerosol precursor composition), part or all of which is intended to be consumed during use by a user. The aerosol provision system 100 may include one or more consumables, and each consumable may include one or more aerosol-generating materials. In some examples in which the aerosol provision system is a hybrid product, the aerosol provision system may include a liquid or gel aerosol-generating material to generate an aerosol, which may then pass through a second, solid aerosol-generating material to pick up additional constituents before reaching the user. These aerosol-generating materials may be within a single consumable or respective consumables that may be separately removable.

The aerosol-generating material 124 is capable of generating aerosol, for example when heated, irradiated or energized in any other way. The aerosol-generating material may be, for example, in the form of a solid, semi-solid, liquid or gel. The aerosol-generating material may include an "amorphous solid," which may be alternatively referred to as a "monolithic solid" (i.e., non-fibrous). In some examples, the amorphous solid may be a dried gel. The amorphous solid is a solid material that may retain some fluid, such as liquid, within it. In some examples, the aerosol-generating material may include from about 50 wt %, 60 wt % or 70 wt % of amorphous solid, to about 90 wt %, 95 wt % or 100 wt % of amorphous solid.

The aerosol-generating material 124 may include one or more of each of a number of constituents such as an active substance 126, flavorant 128, aerosol-former material 130 or other functional material 132.

The active substance 126 may be a physiologically active material, which is a material intended to achieve or enhance a physiological response such as improved alertness, improved focus, increased energy, increased stamina, increased calm or improved sleep. The active substance may for example be selected from nutraceuticals, nootropics, psychoactives. The active substance may be naturally occurring or synthetically obtained. The active substance may include, for example, nicotine, caffeine, GABA (γ-aminobutyric acid), L-theanine, taurine, theine, vitamins such as B6 or B12 (cobalamin) or C, melatonin, cannabinoids, terpenes, or constituents, derivatives, or combinations thereof. The active substance may include one or more constituents, derivatives or extracts of tobacco, cannabis or another botanical.

In some examples in which the active substance 126 includes derivatives or extracts, the active substance may be or include one or more cannabinoids or terpenes.

As noted herein, the active substance 126 may include or be derived from one or more botanicals or constituents, derivatives or extracts thereof. As used herein, the term "botanical" includes any material derived from plants including, but not limited to, extracts, leaves, bark, fibers, stems, roots, seeds, flowers, fruits, pollen, husk, shells or the like. Alternatively, the material may include an active compound naturally existing in a botanical, obtained synthetically. The material may be in the form of liquid, gas, solid, powder, dust, crushed particles, granules, pellets, shreds, strips, sheets, or the like. Example botanicals are tobacco, eucalyptus, star anise, hemp, cocoa, cannabis, fennel, lemongrass, peppermint, spearmint, rooibos, chamomile, flax, ginger, *Ginkgo biloba*, hazel, hibiscus, laurel, licorice (liquorice), matcha, mate, orange skin, papaya, rose, sage, tea such as green tea or black tea, thyme, clove, cinnamon, coffee, aniseed (anise), basil, bay leaves, cardamom, coriander, cumin, nutmeg, oregano, paprika, rosemary, saffron, lavender, lemon peel, mint, juniper, elderflower, vanilla, wintergreen, beefsteak plant, curcuma, turmeric, sandalwood, cilantro, bergamot, orange blossom, myrtle, cassis, valerian, pimento, mace, damien, marjoram, olive, lemon balm, lemon basil, chive, carvi, verbena, tarragon, geranium, mulberry, ginseng, theanine, theacrine, maca, ashwagandha, damiana, guarana, chlorophyll, baobab or any combination thereof. The mint may be chosen from the following mint varieties: *Mentha arventis, Mentha* c.v., *Mentha niliaca, Mentha piperita, Mentha piperita citrata* c.v., *Mentha piperita* c.v, *Mentha spicata crispa, Mentha cardifolia, Mentha longifolia, Mentha suaveolens variegata, Mentha pulegium, Mentha spicata* c.v. and *Mentha suaveolens*.

In yet other examples, the active substance 126 may be or include one or more of 5-hydroxytryptophan (5-HTP)/oxitriptan/*Griffonia simplicifolia*, acetylcholine, arachidonic acid (AA, omega-6), ashwagandha (Withania somnifera), Bacopa monniera, beta alanine, beta-hydroxy-beta-methylbutyrate (HMB), *Centella asiatica*, chai-hu, cinnamon, citicoline, cotinine, creatine, curcumin, docosahexaenoic acid (DHA, omega-3), dopamine, *Dorstenia arifolia, Dorstenia Odorata*, essential oils, GABA, *Galphimia glauca*, glutamic acid, hops, *Kaempferia parviflora* (Thai ginseng), kava, L-carnitine, L-arginine, lavender oil, L-choline, liquorice, L-lysine, L-theanine, L-tryptophan, lutein, magnesium, magnesium L-threonate, myo-inositol, nardostachys chinensis, nitrate, oil-based extract of *Viola odorata*, oxygen, phenylalanine, phosphatidylserine, quercetin, resveratrol, *Rhizoma gastrodiae, Rhodiola, Rhodiola rosea*, rose essential oil, S-adenosylmethionine (SAMe), sceletium tortuosum, schisandra, selenium, serotonin, skullcap, spearmint extract, spikenard, theobromine, tumaric, *Turnera aphrodisiaca*, tyrosine, vitamin A, vitamin B3, or yerba mate.

In some example implementations, the aerosol-generating material 124 includes a flavorant 128. As used herein, the terms "flavorant" and "flavor" refer to materials which, where local regulations permit, may be used to create a desired taste, aroma or other somatosensorial sensation in a product for adult consumers. Flavorants may include naturally occurring flavor materials, botanicals, extracts of botanicals, synthetically obtained materials, or combinations thereof (e.g., tobacco, cannabis, licorice (liquorice), hydrangea, eugenol, Japanese white bark magnolia leaf, chamomile, fenugreek, clove, maple, matcha, menthol, Japanese mint, aniseed (anise), cinnamon, turmeric, Indian spices, Asian spices, herb, wintergreen, cherry, berry, redberry, cranberry, peach, apple, orange, mango, clementine, lemon, lime, tropical fruit, papaya, rhubarb, grape, durian, dragon fruit, cucumber, blueberry, mulberry, citrus fruits, Drambuie, bourbon, scotch, whiskey, gin, tequila, rum, spearmint, peppermint, lavender, aloe vera, cardamom, celery, cascarilla, nutmeg, sandalwood, bergamot, geranium, khat, naswar, betel, shisha, pine, honey essence, rose oil, vanilla, lemon oil, orange oil, orange blossom, cherry blossom, cassia, caraway, cognac, jasmine, ylang-ylang, sage, fennel, wasabi, piment, ginger, coriander, coffee, hemp, a mint oil from any species of the genus *Mentha*, eucalyptus, star anise, cocoa, lemongrass, rooibos, flax, *Ginkgo biloba*, hazel, hibiscus, laurel, mate, orange skin, rose, tea such as green tea or black tea, thyme, juniper, elderflower, basil, bay leaves, cumin, oregano, paprika, rosemary, saffron, lemon peel, mint, beefsteak plant, curcuma, cilantro, myrtle, cassis, valerian, pimento, mace, damien, marjoram, olive, lemon balm, lemon basil, chive, carvi, verbena, tarragon, limonene, thymol, camphene), flavor enhancers, bitterness receptor site blockers, sensorial receptor site activators or stimulators, sugars and/or sugar substitutes (e.g., sucralose, acesulfame potassium, aspartame, saccharine, cyclamates, lactose, sucrose, glucose, fructose, sorbitol, or mannitol), and other additives such as charcoal, chlorophyll, minerals, botanicals, or breath freshening agents. Flavorants may be imitation, synthetic or natural ingredients or blends thereof. Flavorants may be in any suitable form, for example, liquid such as an oil, solid such as a powder, or gas.

In some example implementations, the flavorant 128 may include a sensate, which is intended to achieve a somatosensorial sensation which are usually chemically induced and perceived by the stimulation of the fifth cranial nerve (trigeminal nerve), in addition to or in place of aroma or taste nerves, and these may include agents providing heating, cooling, tingling, numbing effect. A suitable heat effect agent may be, but is not limited to, vanillyl ethyl ether and a suitable cooling agent may be, but not limited to eucolyptol, WS-3.

The aerosol-former material 130 may include one or more constituents capable of forming an aerosol. In some example implementations, the aerosol-former material may include one or more of glycerine, glycerol, propylene glycol, diethylene glycol, triethylene glycol, tetraethylene glycol, 1,3-butylene glycol, erythritol, meso-Erythritol, ethyl vanillate, ethyl laurate, a diethyl suberate, triethyl citrate, triacetin, a diacetin mixture, benzyl benzoate, benzyl phenyl acetate, tributyrin, lauryl acetate, lauric acid, myristic acid, and propylene carbonate.

The one or more other functional materials 132 may include one or more of pH regulators, colouring agents, preservatives, binders, fillers, stabilizers, and/or antioxidants. Suitable binders include, for example, pectin, guar gum, fruit pectin, citrus pectin, tobacco pectin, hydroxyethyl guar gum, hydroxypropyl guar gum, hydroxyethyl locust bean gum, hydroxypropyl locust bean gum, alginate, starch, modified starch, derivatized starch, methyl cellulose, ethyl cellulose, ethylhydroxymethyl cellulose, carboxymethyl cellulose, tamarind gum, dextran, pullalon, konjac flour or xanthan gum.

In some example implementations, the aerosol-generating material 124 may be present on or in a support to form a substrate 134. The support may be or include, for example, paper, card, paperboard, cardboard, reconstituted material (e.g., a material formed from reconstituted plant material, such as reconstituted tobacco, reconstituted hemp, etc.), a plastics material, a ceramic material, a composite material, glass, a metal, or a metal alloy. In some examples, the support includes a susceptor, which may be embedded within the aerosol-generating material, or on one or either side of the aerosol-generating material.

Although not separately shown, in some example implementations, the consumable 104 may further include receptacle structured to engage and hold the aerosol-generating material 124, or substrate 134 with the aerosol-generating material. The receptacle may be or include a reservoir, tank, container, cavity, receiving chamber or the like that is structured to receive and contain the aerosol-generating material or the substrate. The consumable may include an aerosol-generating material transfer component (also referred to as a liquid transport element) configured to transport aerosol-generating material to the aerosol generator 106. The aerosol-generating material transfer component may be adapted to wick or otherwise transport aerosol-generating material via capillary action. In some examples, the aerosol-generating material transfer component may include a microfluidic chip, a micro pump or other suitable component to transport aerosol-generating material.

The aerosol generator 106 (also referred to as an atomizer, aerosolizer or aerosol production component) is configured to energize the aerosol-generating material 124 to generate an aerosol, or otherwise cause generation of an aerosol from the aerosol-generating material. More particularly, in some examples, the aerosol generator may be powered by the power source 110 under control of the circuitry 112 to energize the aerosol-generating material to generate an aerosol.

In some example implementations, the aerosol generator 106 is an electric heater configured to perform electric heating in which electrical energy from the power source is converted to heat energy, which the aerosol-generating material is subject to so as to release one or more volatiles from the aerosol-generating material to form an aerosol. Examples of suitable forms of electric heating include resistance (Joule) heating, induction heating, dielectric and microwave heating, radiant heating, arc heating and the like. More particular examples of suitable electric heaters include resistive heating elements such as wire coils, flat plates, prongs, micro heaters or the like.

In some example implementations, the aerosol generator 106 is configured to cause an aerosol to be generated from the aerosol-generating material without heating, or with only secondary heating. For example, the aerosol generator may be configured to subject the aerosol-generating material to one or more of increased pressure, vibration, or electrostatic energy. More particular examples of these aerosol generators include jet nebulizers, ultrasonic wave nebulizers, vibrating mesh technology (VMT) nebulizers, surface acoustic wave (SAW) nebulizers, and the like.

A jet nebulizer is configured to use compressed gas (e.g., air, oxygen) to break up aerosol-generating material 124 into an aerosol, and an ultrasonic wave nebulizer is configured to use ultrasonic waves to break up aerosol-generating material into an aerosol. A VMT nebulizer includes a mesh, and a piezo material (e.g., piezoelectric material, piezomagnetic material) that may be driven to vibrate and cause the mesh to break up aerosol-generating material into an aerosol. A SAW nebulizer is configured to use surface acoustic waves or Rayleigh waves to break up aerosol-generating material into an aerosol.

In some examples, the aerosol generator 106 may include a susceptor, or the susceptor may be part of the substrate 134. The susceptor is a material that is heatable by penetration with a varying magnetic field generated by a magnetic field generator that may be separate from or part of the aerosol generator. The susceptor may be an electrically-conductive material, so that penetration thereof with a varying magnetic field causes induction heating of the heating material. The heating material may be magnetic material, so that penetration thereof with a varying magnetic field causes magnetic hysteresis heating of the heating material. The susceptor in some examples may be both electrically-conductive and magnetic, so that the susceptor of these examples is heatable by both heating mechanisms.

Although not separately shown, either or both the aerosol provision device 102 or the consumable 104 may include an aerosol-modifying agent. The aerosol-modifying agent is a substance configured to modify the aerosol generated from the aerosol-generating material 124, such as by changing the taste, flavor, acidity or another characteristic of the aerosol. In various examples, the aerosol-modifying agent may be an additive or a sorbent. The aerosol-modifying agent may include, for example, one or more of a flavorant, colorant, water or carbon adsorbent. The aerosol-modifying agent may be a solid, semi-solid, liquid or gel. The aerosol-modifying agent may be in powder, thread or granule form. The aerosol-modifying agent may be free from filtration material. In some examples, the aerosol-modifying agent may be provided in an aerosol-modifying agent release component, that is operable to selectively release the aerosol-modifying agent.

The aerosol provision system 100 and its components including the aerosol provision device 102, consumable 104, and aerosol generator 106 may be manufactured with any of a number of different form factors, and with additional or alternative components relative to those described above.

FIGS. 2 and 3 illustrate an aerosol provision system 200 in the form of a vapor product, and that in some example implementations may correspond to the aerosol provision system 100. As shown, the aerosol provision system 200 may include an aerosol provision device 202 (also referred to as a control body or power unit) and a consumable 204 (also referred to as a cartridge or tank), which may correspond to respectively the aerosol provision device 102 and the consumable 104. The aerosol provision system and in particular the consumable may also include an aerosol generator corresponding to the aerosol generator 106, and in the form of an electric heater 306 such as a heating element like a metal wire coil configured to convert electrical energy to heat energy through resistance (Joule) heating. The aerosol provision device and the consumable can be permanently or detachably aligned in a functioning relationship. FIGS. 2 and 3 illustrate respectively a perspective view and a partially cut-away side view of the aerosol provision system in a coupled configuration.

As seen in FIG. 2 and the cut-away view illustrated in FIG. 3, the aerosol provision device 202 and consumable 204 each include a number of respective components. The components illustrated in FIG. 3 are representative of the components that may be present in an aerosol provision device and consumable and are not intended to limit the scope of components that are encompassed by the present disclosure.

The aerosol provision device 202 may include a housing 208 (sometimes referred to as an aerosol provision device shell) that may include a power source 310. The housing may also include circuitry 312 with a switch in the form of a sensor 314, a user interface including a light source 316 that may be illuminated with use of the aerosol provision system 200, and processing circuitry 318 (also referred to as a control component). The housing may also include a receptacle in the form of a consumable receiving chamber 322 structured to engage and hold the consumable 204. And the consumable may include an aerosol-generating material 324 that may correspond to aerosol-generating material 124, and that may include one or more of each of a number of constituents such as an active substance, flavorant, aerosol-former material or other functional material.

As also seen in FIG. 3, the aerosol provision device 202 may also include electrical connectors 336 positioned in the consumable receiving chamber 322 configured to electrically couple the circuitry and thereby the aerosol provision device with the consumable 204, and in particular electrical contacts 338 on the consumable. In this regard, the electrical connectors and electrical contacts may form a connection interface of the aerosol provision device and consumable. As also shown, the aerosol provision device may include an external electrical connector 340 to connect the aerosol provision device with one or more external devices. Examples of suitable external electrical connectors include USB connectors, proprietary connectors such as Apple's Lightning connector, and the like.

In various examples, the consumable 204 includes a tank portion and a mouthpiece portion. The tank portion and the mouthpiece portion may be integrated or permanently fixed together, or the tank portion may itself define the mouthpiece portion (or vice versa). In other examples, the tank portion and the mouthpiece portion may be separate and removably engaged with one another.

The consumable 204, tank portion and/or mouthpiece portion may be separately defined in relation to a longitudinal axis (L), a first transverse axis (T1) that is perpendicular to the longitudinal axis, and a second transverse axis (T2) that is perpendicular to the longitudinal axis and is perpendicular to the first transverse axis. The consumable can be formed of a housing 242 (sometimes referred to as the consumable shell) enclosing a reservoir 344 (in the tank portion) configured to retain the aerosol-generating material 324. In some examples, the consumable may include an aerosol generator, such as electric heater 306 in the illustrated example. In some examples, the electrical connectors 336 on the aerosol provision device 202 and electrical contacts 338 on the consumable may electrically connect the electric heater with the power source 310 and/or circuitry 312 of the aerosol provision device.

As shown, in some examples, the reservoir 344 may be in fluid communication with an aerosol-generating material transfer component 346 adapted to wick or otherwise transport aerosol-generating material 324 stored in the reservoir housing to the electric heater 306. At least a portion of the aerosol-generating material transfer component may be positioned proximate (e.g., directly adjacent, adjacent, in close proximity to, or in relatively close proximity to) the electric heater. The aerosol-generating material transfer component may extend between the electric heater and the aerosol-generating material stored in the reservoir, and at least a portion of the electric heater may be located above a proximal end the reservoir. For the purposes of the present disclosure, it should be understood that the term "above" in this particular context should be interpreted as meaning toward a proximal end of the reservoir and/or the consumable 204 in direction substantially along the longitudinal axis (L). Other arrangements of the aerosol-generating material transfer component are also contemplated within the scope of the disclosure. For example, in some example implementations, the aerosol-generating material transfer component may be positioned proximate a distal end of the reservoir and/or arranged transverse to the longitudinal axis (L).

The electric heater 306 and aerosol-generating material transfer component 346 may be configured as separate elements that are fluidly connected, the electric heater and aerosol-generating material transfer component or may be configured as a combined element. For example, in some implementations an electric heater may be integrated into an aerosol-generating material transfer component. Moreover, the electric heater and the aerosol-generating material transfer component may be formed of any construction as otherwise described herein. In some examples, a valve may be positioned between the reservoir 344 and electric heater, and configured to control an amount of aerosol-generating material 324 passed or delivered from the reservoir to the electric heater.

An opening 348 may be present in the housing 242 (e.g., at the mouth end of the mouthpiece portion) to allow for egress of formed aerosol from the consumable 204.

As indicated above, the circuitry 312 of the aerosol provision device 202 may include a number of electronic components, and in some examples may be formed of a circuit board such as a PCB that supports and electrically connects the electronic components. The sensor 314 (switch) may be one of these electronic components positioned on the circuit board. In some examples, the sensor may comprise its own circuit board or other base element to which it can be attached. In some examples, a flexible circuit board may be utilized. A flexible circuit board may be configured into a variety of shapes. In some examples, a flexible circuit board may be combined with, layered onto, or form part or all of a heater substrate.

In some examples, the reservoir 344 may be a container for storing the aerosol-generating material 324. In some examples, the reservoir may be or include a fibrous reservoir with a substrate with the aerosol-generating material present on or in a support. For example, the reservoir can comprise one or more layers of nonwoven fibers substantially formed into the shape of a tube encircling the interior of the housing 242, in this example. The aerosol-generating material may be retained in the reservoir. Liquid components, for example, may be sorptively retained by the reservoir. The reservoir may be in fluid connection with the aerosol-generating material transfer component 346. The aerosol-generating material transfer component may transport the aerosol-generating material stored in the reservoir via capillary action—or via a micro pump—to the electric heater 306. As such, the electric heater is in a heating arrangement with the aerosol-generating material transfer component.

In use, when a user draws on the aerosol provision system 200, airflow is detected by the sensor 314, and the electric heater 306 is activated to energize the aerosol-generating material 324 to generate an aerosol. Drawing upon the mouth end of the aerosol provision system causes ambient air to enter and pass through the aerosol provision system. In the consumable 204, the drawn air combines with the aerosol that is whisked, aspirated or otherwise drawn away from the electric heater and out the opening 348 in the mouth end of the aerosol provision system.

Again, as shown in FIGS. 2 and 3, the aerosol generator of the aerosol provision system 200 is an electric heater 306 designed to heat the aerosol-generating material 324 to generate an aerosol. In other implementations, the aerosol generator is designed to break up the aerosol-generating material without heating, or with only secondary heating. FIG. 4 illustrates a nebulizer 400 that may be used to implement the aerosol generator of an aerosol provision system, according to some these other example implementations.

As shown in FIG. 4, the nebulizer 400 includes a mesh plate 402 and a piezo material 404 that may be affixed to one another. The piezo material may be driven to vibrate and cause the mesh plate to break up aerosol-generating material into an aerosol. In some examples, the nebulizer may also include a supporting component located on a side of the mesh plate opposite the piezo material to increase the longevity of the mesh plate, and/or an auxiliary component between the mesh plate and the piezo material to facilitate interfacial contact between the mesh plate and the piezo material.

In various example implementations, the mesh plate 402 may have a variety of different configurations. The mesh plate may have a flat profile, a domed shape (concave or convex with respect to the aerosol-generating material), or a flat portion and a domed portion. The mesh plate defines a plurality of perforations 406 that may be substantially uniform or vary in size across a perforated portion of the mesh plate. The perforations may be circular openings or non-circular openings (e.g., oval, rectangular, triangular, regular polygon, irregular polygon). In three-dimensions, the perforations may have a fixed cross section such as in the case of cylindrical perforations with a fixed circular cross section, or a variable cross section such as in the case of truncated cone perforations with a variable circular cross section. In other implementations, the perforations may be tetragonal or pyramidal.

The piezo material 404 may be or include a piezoelectric material or a piezomagnetic material. A piezoelectric material may be coupled to circuitry configured to produce an oscillating electric signal to drive the piezoelectric material to vibrate. For a piezomagnetic material, the circuitry may produce a pair of antiphase, oscillating electric signals to drive a pair of magnets to produce antiphase, oscillating magnetic fields that drives the piezomagnetic material to vibrate.

The piezo material 404 may be affixed to the mesh plate 402, and vibration of the piezo material may in turn cause the mesh plate to vibrate. The mesh plate may be in contact with or immersed in aerosol-generating material, in sufficient proximity of aerosol-generating material, or may otherwise receive aerosol-generating material via an aerosol-generating material transfer component. The vibration of the mesh plate, then, may cause the aerosol-generating material to pass through the perforations 406 that break up the aerosol-generating material into an aerosol. More particularly, in some examples, aerosol-generating material may be driven through the perforations 406 in the vibrating mesh plate 402 resulting in aerosol particles. In other examples in which the mesh plate is in contact with or immersed in aerosol-generating material, the vibrating mesh plate may create ultrasonic waves within aerosol-generating material that cause formation of an aerosol at the surface of the aerosol-generating material.

As described above, hybrid products use a combination of aerosol-generating materials, and some hybrid products are similar to vapor products except that the aerosol generated from one aerosol-generating material may pass through a second aerosol-generating material to pick up additional constituents. Another similar aerosol provision system in the form of a hybrid product may therefore be constructed similar to the vapor product in FIGS. 2 and 3 (with an electric heater 306 or a nebulizer 400). The hybrid product may include a second aerosol-generating material through which aerosol from the aerosol-generating material 324 is passed to pick up additional constituents before passing through the opening 348 in the mouth end of the aerosol provision system.

FIG. 5 is a block diagram of an aerosol provision system 500 according to some example implementations. The aerosol provision system 500 of FIG. 5 may be part of or separate from the aerosol provision system 100 of FIG. 1. In this regard, the aerosol provision system 500 includes the aerosol provision device 102 with the coupler 120 and/or receptacle 122 structured to engage and hold a consumable 104 with aerosol-generating material 124. The coupler and/or receptacle are also structured to at least engage if not also hold a non-consumable 504 without aerosol-generating material. That is, the aerosol provision device includes the coupler and/or receptacle structured to separately and individually engage articles of different types including consumables with aerosol-generating material, and non-consumables without aerosol-generating material.

The non-consumable 504 is one of a number of non-consumables without aerosol-generating material, but that have target electrical resistances 506 associated with respective settings of the aerosol provision device 102. In some examples, a non-consumable may be equipped with a resistor that has a target resistance that is associated with a respective setting. In other examples, the non-consumable may be equipped with multiple resistors that are connected in series or parallel, and that have a collective equivalent resistance that is the target resistance. The target resistance may be a resistance value, or a range of resistance values. One example of a suitable range of resistance values is reflected by a target resistance value+/− an acceptable tolerance from the target resistance value. The target electrical resistances of the non-consumables may be defined so that the target electrical resistances are sufficiently different from an electrical resistance of a consumable 104 so that the aerosol provision device may distinguish between the different types of articles.

According to some example implementations of the present disclosure, the processing circuitry 118 of the aerosol provision device 102 may be configured to detect engagement of an article with the coupler 120 or receptacle 122 and thereby the aerosol provision device. Automatically as a direct result of the engagement, then, the processing circuitry may be configured to measure an electrical resistance 506 of the article that indicates the article is a non-consumable 504 (as opposed to a consumable 104).

The electrical resistance of the article may be measured in any of a number of different manners. In a particular example, the non-consumable 504 may include a resistor, and the processing circuitry 118 may be configured to measure the electrical resistance 506 of the resistor. This may include the processing circuitry configured to control power from the power source 110 to apply a voltage across the resistor for a short duration (e.g., 20 milliseconds), measure the voltage across and a current through the resistor, and determine the electrical resistance from the voltage and the current. Second, after a valid non-consumable 504 is read, the processing circuitry 118 may wait a duration (e.g., 5 milliseconds), repeat the process to determine the electrical resistance, and only proceed if the same electrical resistance is determined on both attempts.

The processing circuitry 118 may be configured to identify one of the target electrical resistances that most closely matches the electrical resistance 506 of the article. The target electrical resistances may be set with a buffer between their values that reduces a likelihood that an unintended one of the target electrical resistances is identified from the electrical resistance measured by the processing circuitry. Additionally or alternatively, the processing circuitry may make multiple measurements of the electrical resistance, identify one of the target electrical resistances for respective ones of the multiple measurements, and only proceed when the one of the target electrical resistances is the same for the multiple measurements.

The processing circuitry 118 may be configured to identify a setting of the respective settings that is associated with the one of the target electrical resistances, and change a value of the setting. And in some examples, an output device (e.g., LEDs, quantum dot-based LED, display device, loudspeaker, vibration motor) of the UI 116 may be configured to provide information in a human-perceptible form that indicates the change of the value of the setting.

In some examples, the processing circuitry 118 may be configured to detect engagement of a second article with the coupler 120 or receptacle 122. The processing circuitry may be configured to determine the electrical resistance of the second article that indicates the second article is a consumable 102. And the processing circuitry may be configured to control power to the aerosol generator 106 to energize the aerosol-generating material 124 to generate an aerosol for delivery to a user.

In some examples, the processing circuitry 118 may be configured to change the setting of the aerosol provision device automatically as the direct result of each engagement of the non-consumable 504 with the coupler 120 or receptacle 122 and thereby the aerosol provision device 102. In this regard, the processing circuitry may be configured to toggle the setting between a first value and a second value, or cycle the setting between a sequence of values. Although each of the non-consumables may have a target resistance associated with one of the respective settings; in some examples, the target resistance may be associated with multiple ones of the respective settings. In these examples, the processing circuitry may be configured to toggle or cycle between the multiple ones of the respective settings, and toggle or cycle between values of each of the multiple settings when on the setting.

The respective settings of the aerosol provision device that are associated with the target electrical resistances 506 of the non-consumables 504 may include any of a number of different settings. Examples of respective settings include those for one or more of a power mode, an automatic mode, a color mode, a brightness mode, a power indicator mode, a haptic-feedback mode, a haptic-pattern mode, a lock mode, a debug mode, debug-mode outputs, a killswitch a shelf mode, or a switch sensitivity.

One of the non-consumables 504 may have a target electrical resistance 506 associated with the power mode of the aerosol provision device 102. The power mode may be used to select a level of power provided to the aerosol generator 106 when a consumable 104 is engaged with the aerosol provision device. In this regard, the power mode may be cycled between values corresponding to an automatic mode and modes of different levels of power provided to the aerosol generator. The automatic mode may be further used to select a profile of the power that is provided to the aerosol generator, and the profile of the automatic mode may be cycled between values that correspond to profiles according to which the power is provided to the aerosol generator. Examples of suitable profiles include a step function, a linear ramp, or a combination of step function and linear ramp.

One of the non-consumables 504 may have a target electrical resistance 506 associated with the color mode, and this mode may be a mode of a light source of the UI 116 that is used to select a color scheme of the aerosol provision device 102. The color mode may be cycled between values corresponding to different color schemes. Another of the consumables may have a target electrical resistance associated with the brightness mode used to select a brightness of the light source, and the brightness mode may be toggled between a day mode (normal brightness) and a night mode.

A non-consumable 504 may have a target electrical resistance 506 associated with the power indicator mode that may be used to indicate a charge level of the power source 110 by a light source of the UI 116, and this mode may be toggled between on an off. The same or another non-consumable may be for a power indicator mode to indicate a status of a lifespan of the power source, and this mode may also be toggled between on an off.

One of the non-consumables 504 may have a target electrical resistance 506 associated with the haptic-feedback mode that is used to select an intensity of haptic feedback provided by a vibration motor of the UI 116, and this mode may be cycled between values corresponding to different intensities of the haptic feedback. Another of the non-consumables may have a target electrical resistance associated with the haptic-pattern mode used to select a pattern of the haptic feedback provided by the vibration motor, and this mode may be cycled between values corresponding to different patterns of the haptic feedback.

A non-consumable 504 may have a target electrical resistance 506 associated with the lock mode used to lock the aerosol provision device 102, and the lock mode may be toggled between locked and unlocked. Similarly, a non-consumable may have a target electrical resistance associated with the debug mode to enter the aerosol provision device into a debug mode for use during development or testing of the aerosol provision device, and this mode may also be toggled between on and off. In a further example, yet another non-consumable may have a target electrical resistance associated with debug-mode outputs that are cycled between values corresponding to respective sensor outputs when the debug mode is on. These may include a flow sensor, a pressure sensor, a temperature sensor and the like.

One of the non-consumables 504 may have a target electrical resistance 506 associated with a killswitch that is used to disable the aerosol provision device 102 from either or both charging operations or discharging operations. The killswitch may be or include a software function of the circuitry 112 that the circuitry may be configured to set responsive to detection of any of a number of different events. Examples of suitable events include unintended use of the aerosol provision device, unauthorized use of the aerosol provision device, a fault or failure of the aerosol provision device or one or more components of the aerosol provision device, or the like, a test of the aerosol provision device, and the like. The killswitch may be toggled between set and cleared (or reset) using one of the non-consumables. In some examples, the killswitch may be limited to being set only when the aerosol provision device is in the debug mode.

A non-consumable 504 may have a target electrical resistance 506 associated with shelf mode to enter the aerosol provision device 102 into a shelf mode, such as when the aerosol provision device is packaged for distribution to retailers. In this mode, the aerosol provision device is in a low-power consumption state to limit drain of the power source 110 during long time periods in which the aerosol provision device is stored without use. The shelf mode may be toggled between on and off.

Yet another of the non-consumables 504 may have a target electrical resistance 506 associated setting a sensitivity of the switch 114 (e.g., flow sensor, pressure sensor) that may be directly or indirectly manipulated by a user to activate the aerosol provision device 102 and thereby the aerosol provision system 100. In some examples, the sensitivity of the switch may be cycled between values corresponding to different levels of sensitivity.

To further illustrate some example implementations, below are examples of various target resistances and descriptions of the settings whose values may be toggled or cycled.

| Target Resistance (Ω) | Description |
|---|---|
| 3.3 ± 10% | Cycle between automatic, low-power, medium-power and high-power modes |
| 4.3 ± 10% | Cycle between light source color schemes |
| 5.6 ± 10% | Toggle light source brightness between normal brightness (day mode) and night mode |
| 7.5 ± 10% | Cycle haptic intensity between low, medium, high |
| 10 ± 10% | Toggle lock mode on and off |
| 13 ± 10% | Toggle debug mode on and off |
| 18 ± 10% | Cycle through available debug mode outputs |
| 24 ± 10% | Set or clear killswitch (when debug mode is enabled) |

The aerosol provision system 500 and its components including the aerosol provision device 102 and non-consumable 504 may be manufactured with any of a number of different form factors, and with additional or alternative components relative to those described above. FIG. 6 illustrates an aerosol provision system 600 in the form of a vapor product that includes the aerosol provision device 202 of FIGS. 2 and 3, and a non-consumable 604, according to some example implementations. Similar to before, the aerosol provision system 600 of FIG. 6 may be part of or separate from the aerosol provision system 200 of FIGS. 2 and 3. As shown, the non-consumable may have the same or a similar form factor as the consumable 204.

As shown in FIGS. 3 and 6, the housing 208 of the aerosol provision device 202 may include a receptacle in the form of a consumable receiving chamber 322 structured to engage and hold the consumable 204. The consumable receiving chamber may be likewise structured to engage and hold the non-consumable 604. And whereas the consumable may include an aerosol-generating material 324, the non-consumable is devoid of or otherwise without aerosol-generating material. The non-consumable may instead be equipped with a resistor 606 that has a target resistance. As shown, the non-consumable can be formed of a housing 642 (sometimes referred to as the non-consumable shell) that encloses the resistor.

As also shown in FIGS. 3 and 6, the aerosol provision device 202 may also include electrical connectors 336 positioned in the consumable receiving chamber 322 configured to electrically couple the circuitry 312 and thereby the aerosol provision device with the consumable 204, and in particular electrical contacts 338 on the consumable 204. Similarly, the electrical connectors may be configured to electrically couple the circuitry and thereby the aerosol provision device with the non-consumable 604, and in particular electrical contacts 608 on the consumable. The electrical connectors and electrical contacts may form a connection interface of the aerosol provision device and non-consumable. In some examples, then, the processing circuitry 318 may be configured to measure the electrical resistance of the resistor 606 and thereby the non-consumable at the electrical connectors.

FIGS. 7A-7E are flowcharts illustrating various steps in a method 700 of operating an aerosol provision device, according to various example implementations of the present disclosure. The aerosol provision device includes one or more of a coupler or a receptacle structured to separately and individually engage articles of different types including consumables with aerosol-generating material, and non-consumables without aerosol-generating material. The non-consumables have target electrical resistances associated with respective settings of the aerosol provision device.

Figure 7A:
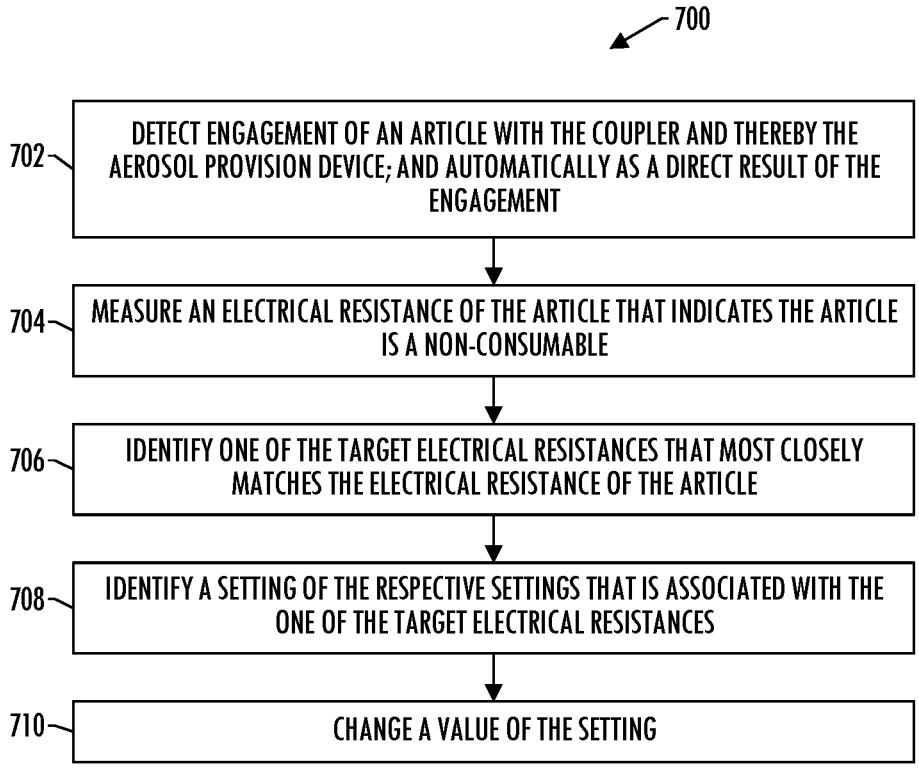

The method 700 includes detecting engagement of an article with the coupler or receptacle and thereby the aerosol provision device, as shown at block 702 of FIG. 7A. The method includes, automatically as a direct result of the engagement, measuring an electrical resistance of the article that indicates the article is a non-consumable, as shown at block 704. The method includes identifying one of the target electrical resistances that most closely matches the electrical resistance of the article, as shown at block 706. The method includes identifying a setting of the respective settings that is associated with the one of the target electrical resistances, as shown at block 708. And the method includes changing a value of the setting, as shown at block 710.

Figure 7B:
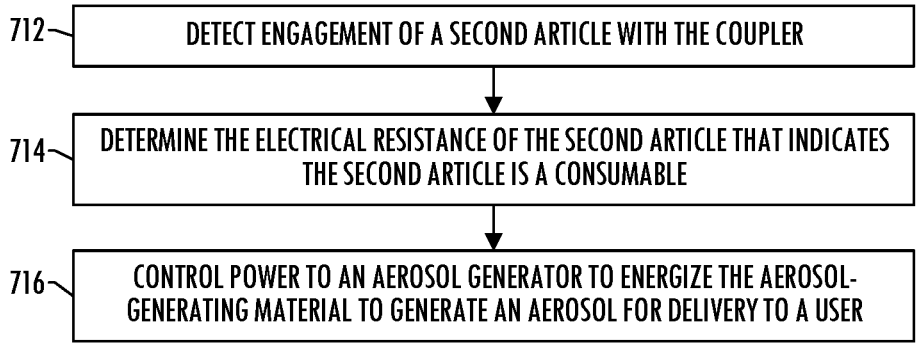

In some examples, the method 700 further includes detecting engagement of a second article with the coupler or receptacle, as shown at block 712 of FIG. 7B. The method includes determining the electrical resistance of the second article that indicates the second article is a consumable, as shown at block 714. And the method includes controlling power to an aerosol generator to energize the aerosol-generating material to generate an aerosol for delivery to a user, as shown at block 716.

In some examples, the coupler or receptacle includes electrical connectors configured to electrically couple the circuitry and thereby the aerosol provision device with the article. In some of these examples, the electrical resistance of the article is measured at block 704 at the electrical connectors.

Figure 7C:
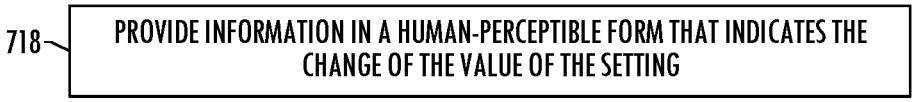

In some examples, the method 700 further includes an output device of the aerosol provision device providing information in a human-perceptible form that indicates the change of the value of the setting, as shown at block 718 of FIG. 7C.

In some examples, the value of the setting of the aerosol provision device is automatically changed at block 710 as the direct result of each engagement of the non-consumable with the coupler or receptacle and thereby the aerosol provision device.

Figure 7D:
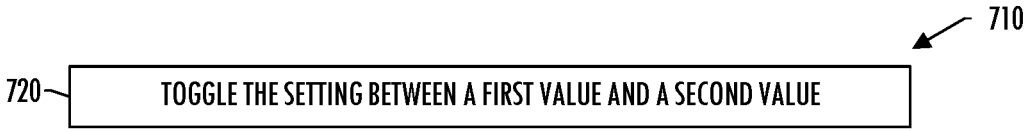
Figure 7E:
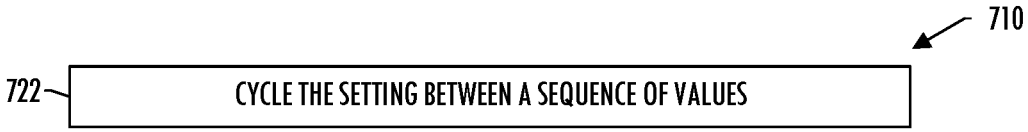

In some examples, changing the value of the setting at block 710 includes toggling the setting between a first value and a second value, as shown at block 720 of FIG. 7D. And in some examples, changing the value of the setting at block 710 includes cycling the setting between a sequence of values, as shown at block 722 of FIG. 7E.

As explained above and reiterated below, the present disclosure includes, without limitation, the following example implementations.

Clause 1. An aerosol provision system comprising: a non-consumable of a number of non-consumables without aerosol-generating material, the non-consumables having target electrical resistances associated with respective settings of the aerosol provision device; and aerosol provision device structured to separately and individually engage articles of different types including consumables with aerosol-generating material, and the non-consumables, the aerosol provision device configured to at least: detect engagement of an article with the aerosol provision device; and automatically as a direct result of the engagement, measure an electrical resistance of the article that indicates the article is the non-consumable; identify one of the target electrical resistances that most closely matches the electrical resistance of the article; identify a setting of the respective settings that is associated with the one of the target electrical resistances; and change a value of the setting.

Clause 2. The aerosol provision system of clause 1, wherein the aerosol provision device is further configured to at least: detect engagement of a second article with the aerosol provision device; determine the electrical resistance of the second article that indicates the second article is a consumable; and control power to an aerosol generator to energize the aerosol-generating material to generate an aerosol for delivery to a user.

Clause 3. The aerosol provision system of clause 1 or clause 2, wherein the aerosol provision device includes electrical connectors configured to electrically couple the aerosol provision device with the article, and wherein the aerosol provision device is configured to measure the electrical resistance of the article at the electrical connectors.

Clause 4. The aerosol provision system of any of clauses 1 to 3, wherein the aerosol provision device includes an output device configured to provide information in a human-perceptible form that indicates the change of the value of the setting.

Clause 5. The aerosol provision system of any of clauses 1 to 4, wherein the aerosol provision device is configured to change the setting of the aerosol provision device automatically as the direct result of each engagement of the non-consumable with the aerosol provision device.

Clause 6. The aerosol provision system of clause 5, wherein the aerosol provision device configured to change the value of the setting includes the aerosol provision device configured to toggle the setting between a first value and a second value.

Clause 7. The aerosol provision system of clause 5 or clause 6, wherein the aerosol provision device configured to change the value of the setting includes the aerosol provision device configured to cycle the setting between a sequence of values.

Clause 8. The aerosol provision system of any of clauses 1 to 7, wherein the setting identified is a power mode of the aerosol provision device that is cycled between values corresponding to an automatic mode and modes of different levels of power provided to an aerosol generator when a consumable is engaged with the aerosol provision device.

Clause 9. The aerosol provision system of any of clauses 1 to 8, wherein the aerosol provision device has an automatic mode according to which power is provided to an aerosol generator when a consumable is engaged with the aerosol provision device, and the setting identified is a profile of the automatic mode that is cycled between values that correspond to profiles according to which the power is provided to the aerosol generator.

Clause 10. The aerosol provision system of any of clauses 1 to 9, wherein the aerosol provision device includes a light source, and the setting identified is a color mode of the light source that is cycled between values corresponding to different color schemes.

Clause 11. The aerosol provision system of any of clauses 1 to 10, wherein the aerosol provision device includes a light source, and the setting identified is a brightness mode of the light source that is toggled between a day mode and a night mode.

Clause 12. The aerosol provision system of any of clauses 1 to 11, wherein the aerosol provision device further includes a power source, the aerosol provision device includes a light source, and the setting identified is power indicator mode of the light source that indicates a charge level of the power source, and that is toggled between on an off.

Clause 13. The aerosol provision system of any of clauses 1 to 12, wherein the aerosol provision device further includes a power source, the aerosol provision device includes a light source, and the setting identified is power indicator mode of the light source that indicates a status of a lifespan of the power source, and that is toggled between on an off.

Clause 14. The aerosol provision system of any of clauses 1 to 13, wherein the aerosol provision device includes a vibration motor configured to provide haptic feedback, and the setting identified is a haptic-feedback mode of the vibration motor that is cycled between values corresponding to different intensities of the haptic feedback.

Clause 15. The aerosol provision system of any of clauses 1 to 14, wherein the aerosol provision device includes a vibration motor configured to provide haptic feedback, and the setting identified is a haptic-pattern mode of the vibration motor that is cycled between values corresponding to different patterns of the haptic feedback.

Clause 16. The aerosol provision system of any of clauses 1 to 15, wherein the setting identified is a lock mode of the aerosol provision device that is toggled between locked and unlocked.

Clause 17. The aerosol provision system of any of clauses 1 to 16, wherein the setting identified is a debug mode of the aerosol provision device that is toggled between on and off.

Clause 18. The aerosol provision system of clause 17, wherein the respective settings further include debug-mode outputs that are cycled between values corresponding to respective sensor outputs when the debug mode is on.

Clause 19. The aerosol provision system of any of clauses 1 to 18, wherein the setting identified is a shelf mode of the aerosol provision device that is toggled between on and off.

Clause 20. The aerosol provision system of any of clauses 1 to 19, wherein the aerosol provision device includes a switch that is manipulatable by a user to activate the aerosol provision device, and the setting identified is a sensitivity of the switch that is cycled between values corresponding to different levels of sensitivity.

Clause 21. An aerosol provision device comprising: one or more of a coupler or a receptacle structured to separately and individually engage articles of different types including consumables with aerosol-generating material, and non-consumables without aerosol-generating material, the non-consumables having target electrical resistances associated with respective settings of the aerosol provision device; and circuitry that includes processing circuitry configured to at least: detect engagement of an article with the coupler or receptacle and thereby the aerosol provision device; and automatically as a direct result of the engagement, measure an electrical resistance of the article that indicates the article is a non-consumable; identify one of the target electrical resistances that most closely matches the electrical resistance of the article; identify a setting of the respective settings that is associated with the one of the target electrical resistances; and change a value of the setting.

Clause 22. The aerosol provision device of clause 21, wherein the processing circuitry is further configured to at least: detect engagement of a second article with the coupler or receptacle; determine the electrical resistance of the second article that indicates the second article is a consumable; and control power to an aerosol generator to energize the aerosol-generating material to generate an aerosol for delivery to a user.

Clause 23. The aerosol provision device of clause 21 or clause 22, wherein the coupler or receptacle includes electrical connectors configured to electrically couple the circuitry and thereby the aerosol provision device with the article, and wherein the processing circuitry is configured to measure the electrical resistance of the article at the electrical connectors.

Clause 24. The aerosol provision device of any of clauses 21 to 23, wherein the circuitry further includes an output device configured to provide information in a human-perceptible form that indicates the change of the value of the setting.

Clause 25. The aerosol provision device of any of clauses 21 to 24, wherein the processing circuitry is configured to change the setting of the aerosol provision device automatically as the direct result of each engagement of the non-consumable with the coupler or receptacle and thereby the aerosol provision device.

Clause 26. The aerosol provision device of clause 25, wherein the processing circuitry configured to change the value of the setting includes the processing circuitry configured to toggle the setting between a first value and a second value.

Clause 27. The aerosol provision device of clause 25 or clause 26, wherein the processing circuitry configured to change the value of the setting includes the processing circuitry configured to cycle the setting between a sequence of values.

Clause 28. The aerosol provision device of any of clauses 21 to 27, wherein the setting identified is a power mode of the aerosol provision device that is cycled between values corresponding to an automatic mode and modes of different levels of power provided to an aerosol generator when a consumable is engaged with the aerosol provision device.

Clause 29. The aerosol provision device of any of clauses 21 to 28, wherein the aerosol provision device has an automatic mode according to which power is provided to an aerosol generator when a consumable is engaged with the aerosol provision device, and the setting identified is a profile of the automatic mode that is cycled between values that correspond to profiles according to which the power is provided to the aerosol generator.

Clause 30. The aerosol provision device of any of clauses 21 to 29, wherein the circuitry further includes a light source, and the setting identified is a color mode of the light source that is cycled between values corresponding to different color schemes.

Clause 31. The aerosol provision device of any of clauses 21 to 30, wherein the circuitry further includes a light source, and the setting identified is a brightness mode of the light source that is toggled between a day mode and a night mode.

Clause 32. The aerosol provision device of any of clauses 21 to 31, wherein the aerosol provision device further includes a power source, the circuitry further includes a light source, and the setting identified is power indicator mode of the light source that indicates a charge level of the power source, and that is toggled between on an off.

Clause 33. The aerosol provision device of any of clauses 21 to 32, wherein the aerosol provision device further includes a power source, the circuitry further includes a light source, and the setting identified is power indicator mode of the light source that indicates a status of a lifespan of the power source, and that is toggled between on an off.

Clause 34. The aerosol provision device of any of clauses 21 to 33, wherein the circuitry further includes a vibration motor configured to provide haptic feedback, and the setting identified is a haptic-feedback mode of the vibration motor that is cycled between values corresponding to different intensities of the haptic feedback.

Clause 35. The aerosol provision device of any of clauses 21 to 34, wherein the circuitry further includes a vibration motor configured to provide haptic feedback, and the setting identified is a haptic-pattern mode of the vibration motor that is cycled between values corresponding to different patterns of the haptic feedback.

Clause 36. The aerosol provision device of any of clauses 21 to 35, wherein the setting identified is a lock mode of the aerosol provision device that is toggled between locked and unlocked.

Clause 37. The aerosol provision device of any of clauses 21 to 36, wherein the setting identified is a debug mode of the aerosol provision device that is toggled between on and off.

Clause 38. The aerosol provision device of clause 37, wherein the respective settings further include debug-mode outputs that are cycled between values corresponding to respective sensor outputs when the debug mode is on.

Clause 39. The aerosol provision device of any of clauses 21 to 38, wherein the setting identified is a shelf mode of the aerosol provision device that is toggled between on and off.

Clause 40. The aerosol provision device of any of clauses 21 to 39, wherein the circuitry further includes a switch that is manipulatable by a user to activate the aerosol provision device, and the setting identified is a sensitivity of the switch that is cycled between values corresponding to different levels of sensitivity.

Clause 41. A method of operating an aerosol provision device that includes one or more of a coupler or a receptacle structured to separately and individually engage articles of different types including consumables with aerosol-generating material, and non-consumables without aerosol-generating material, the non-consumables having target electrical resistances associated with respective settings of the aerosol provision device, the method comprising: detecting engagement of an article with the coupler or receptacle and thereby the aerosol provision device; and automatically as a direct result of the engagement, measuring an electrical resistance of the article that indicates the article is a non-consumable; identifying one of the target electrical resistances that most closely matches the electrical resistance of the article; identifying a setting of the respective settings that is associated with the one of the target electrical resistances; and changing a value of the setting.

Clause 42. The method of clause 41, wherein the method further comprises: detecting engagement of a second article with the coupler or receptacle; determining the electrical resistance of the second article that indicates the second article is a consumable; and controlling power to an aerosol generator to energize the aerosol-generating material to generate an aerosol for delivery to a user.

Clause 43. The method of clause 41 or clause 42, wherein the coupler or receptacle includes electrical connectors configured to electrically couple the circuitry and thereby the aerosol provision device with the article, and wherein the electrical resistance of the article is measured at the electrical connectors.

Clause 44. The method of any of clauses 41 to 43, wherein the method further comprises an output device of the aerosol provision device providing information in a human-perceptible form that indicates the change of the value of the setting.

Clause 45. The method of any of clauses 41 to 44, wherein the setting of the aerosol provision device is automatically changed as the direct result of each engagement of the non-consumable with the coupler or receptacle and thereby the aerosol provision device.

Clause 46. The method of clause 45, wherein changing the value of the setting includes toggling the setting between a first value and a second value.

Clause 47. The method of clause 45 or clause 46, wherein changing the value of the setting includes cycling the setting between a sequence of values.

Clause 48. The method of any of clauses 41 to 47, wherein the setting identified is a power mode of the aerosol provision device that is cycled between values corresponding to an automatic mode and modes of different levels of power provided to an aerosol generator when a consumable is engaged with the aerosol provision device.

Clause 49. The method of any of clauses 41 to 48, wherein the aerosol provision device has an automatic mode according to which power is provided to an aerosol generator when a consumable is engaged with the aerosol provision device, and the setting identified is a profile of the automatic mode that is cycled between values that correspond to profiles according to which the power is provided to the aerosol generator.

Clause 50. The method of any of clauses 41 to 49, wherein the circuitry further includes a light source, and the setting identified is a color mode of the light source that is cycled between values corresponding to different color schemes.

Clause 51. The method of any of clauses 41 to 50, wherein the circuitry further includes a light source, and the setting identified is a brightness mode of the light source that is toggled between a day mode and a night mode.

Clause 52. The method of any of clauses 41 to 51, wherein the aerosol provision device further includes a power source, the circuitry further includes a light source, and the setting identified is power indicator mode of the light source that indicates a charge level of the power source, and that is toggled between on an off.

Clause 53. The method of any of clauses 41 to 52, wherein the aerosol provision device further includes a power source, the circuitry further includes a light source, and the setting identified is power indicator mode of the light source that indicates a status of a lifespan of the power source, and that is toggled between on an off.

Clause 54. The method of any of clauses 41 to 53, wherein the circuitry further includes a vibration motor configured to provide haptic feedback, and the setting identified is a haptic-feedback mode of the vibration motor that is cycled between values corresponding to different intensities of the haptic feedback.

Clause 55. The method of any of clauses 41 to 54, wherein the circuitry further includes a vibration motor configured to provide haptic feedback, and the setting identified is a haptic-pattern mode of the vibration motor that is cycled between values corresponding to different patterns of the haptic feedback.

Clause 56. The method of any of clauses 41 to 55, wherein the setting identified is a lock mode of the aerosol provision device that is toggled between locked and unlocked.

Clause 57. The method of any of clauses 41 to 56, wherein the setting identified is a debug mode of the aerosol provision device that is toggled between on and off.

Clause 58. The method of clause 57, wherein the respective settings further include debug-mode outputs that are cycled between values corresponding to respective sensor outputs when the debug mode is on.

Clause 59. The method of any of clauses 41 to 58, wherein the setting identified is a shelf mode of the aerosol provision device that is toggled between on and off.

Clause 60. The method of any of clauses 41 to 59, wherein the circuitry further includes a switch that is manipulatable by a user to activate the aerosol provision device, and the setting identified is a sensitivity of the switch that is cycled between values corresponding to different levels of sensitivity.

Many modifications and other implementations of the disclosure will come to mind to one skilled in the art to which this disclosure pertains having the benefit of the teachings presented in the foregoing descriptions and the associated figures. Therefore, it is to be understood that the disclosure is not to be limited to the specific implementations disclosed herein and that modifications and other implementations are intended to be included within the scope of the appended claims. Although specific terms are employed herein, they are used in a generic and descriptive sense only and not for purposes of limitation.

What is claimed is:

1. An aerosol provision device comprising:

one or more of a coupler or a receptacle structured to separately and individually engage articles of different types including consumables with aerosol-generating material, and non-consumables without aerosol-generating material, the non-consumables having target electrical resistances associated with respective settings of the aerosol provision device, the coupler or receptacle including electrical connectors configured to electrically couple the aerosol provision device with the article; and circuitry electrically coupled with the electrical connectors, the circuitry including processing circuitry configured to at least:

detect engagement of an article with the coupler or receptacle and thereby the aerosol provision device; and automatically as a direct result of the engagement, measure, at the electrical connectors, an electrical resistance through an electrical component within the article, the article being engaged with the coupler or receptacle;

determine from the measured electrical resistance of the article engaged with the coupler or receptacle whether the article is consumable or non-consumable;

identify, if the article is determined to be non-consumable, one of the target electrical resistances that most closely matches the measured electrical resistance of the non-consumable article;

identify a setting of the respective settings that is associated with the identified one of the target electrical resistances; and change a value of the setting of the aerosol provision device associated with the identified one of the target electrical resistances to effect a change in function of the aerosol provision device.

2. The aerosol provision device of claim 1, wherein the processing circuitry is further configured to at least:

detect engagement of a second article with the coupler or receptacle;

measure, at the electrical connectors, an electrical resistance of the second article engaged with the coupler or receptacle;

determine from the measured electrical resistance of the second article engaged with the coupler or receptacle whether the second article is consumable or non-consumable; and if the second article is determined to be consumable, control power to an aerosol generator to energize the aerosol-generating material to generate an aerosol for delivery to a user.

3. The aerosol provision device of claim 1, wherein the processing circuitry is configured to change the value of the setting of the aerosol provision device automatically as the direct result of each engagement of the article determined to be non-consumable with the coupler or receptacle and thereby the aerosol provision device.

4. The aerosol provision device of claim 3, wherein the processing circuitry configured to change the value of the setting includes the processing circuitry configured to toggle the setting between a first value and a second value, or cycle the setting between a sequence of values.

5. The aerosol provision device of claim 1, wherein the setting identified is a power mode of the aerosol provision device that is cycled between values corresponding to an automatic mode and modes of different levels of power provided to an aerosol generator when a second article determined to be consumable is engaged with the coupler or receptacle and thereby the aerosol provision device.

6. The aerosol provision device of claim 1, wherein the aerosol provision device has an automatic mode according to which power is provided to an aerosol generator when a second article determined to be consumable is engaged with the coupler or receptacle and thereby the aerosol provision device, and the setting identified is a profile of the automatic mode that is cycled between values that correspond to profiles according to which the power is provided to the aerosol generator.

7. The aerosol provision device of claim 1, wherein the circuitry further includes a light source, and the setting identified is a color mode of the light source that is cycled between values corresponding to different color schemes.

8. The aerosol provision device of claim 1, wherein the aerosol provision device further includes a power source, the circuitry further includes a light source, and the setting identified is a power indicator mode of the light source that indicates a charge level or a status of a lifespan of the power source, and that is toggled between on an off.

9. The aerosol provision device of claim 1, wherein the setting identified is a lock mode of the aerosol provision device that is toggled between locked and unlocked.

10. A method of operating an aerosol provision device that includes one or more of a coupler or a receptacle structured to separately and individually engage articles of different types including consumables with aerosol-generating material, and non-consumables without aerosol-generating material, the non-consumables having target electrical resistances associated with respective settings of the aerosol provision device, the coupler or receptacle including electrical connectors configured to electrically couple the aerosol provision device with the article, and circuitry electrically coupled with the electrical connectors, the circuitry including processing circuitry, the method comprising the processing circuitry:

detecting engagement of an article with the coupler or receptacle and thereby the aerosol provision device; and automatically as a direct result of the engagement, measuring, at the electrical connectors, an electrical resistance through an electrical component within the article, the article being engaged with the coupler or receptacle;

determining from the measured electrical resistance of the article engaged with the coupler or receptacle whether the article is consumable or non-consumable;

identifying, if the article is determined to be non-consumable, one of the target electrical resistances that most closely matches the measured electrical resistance of the article;

identifying a setting of the respective settings that is associated with the identified one of the target electrical resistances; and changing a value of the setting of the aerosol provision device associated with the identified one of the target electrical resistances to effect a change in function of the aerosol provision device.

11. The method of claim 10, wherein the method further comprises the processing circuitry:

detecting engagement of a second article with the coupler or receptacle;

measuring, at the electrical connectors, an electrical resistance of the second article engaged with the coupler or receptacle;

determining from the measured electrical resistance of the second article engaged with the coupler or receptacle whether the second article is consumable or non-consumable; and if the second article is determined to be consumable, controlling power to an aerosol generator to energize the aerosol-generating material to generate an aerosol for delivery to a user.

12. The method of claim 10, wherein the value of the setting of the aerosol provision device is automatically changed by the processing circuitry as the direct result of each engagement of the non-consumable with the coupler or receptacle and thereby the aerosol provision device.

13. The method of claim 12, wherein the processing circuitry changing the value of the setting includes the processing circuitry toggling the setting between a first value and a second value, or cycling the setting between a sequence of values.

14. The method of claim 10, wherein the setting identified by the processing circuitry is a power mode of the aerosol provision device that is cycled by the processing circuitry between values corresponding to an automatic mode and modes of different levels of power provided to an aerosol generator when a consumable is engaged with the coupler or receptacle and thereby the aerosol provision device.

15. The method of claim 10, wherein the aerosol provision device has an automatic mode according to which power is provided to an aerosol generator when a consumable is engaged with the aerosol provision device, and the setting identified by the processing circuitry is a profile of the automatic mode that is cycled by the processing circuitry between values that correspond to profiles according to which the power is provided to the aerosol generator.

16. The method of claim 10, wherein the circuitry further includes a light source, and the setting identified by the processing circuitry is a color mode of the light source that is cycled by the processing circuitry between values corresponding to different color schemes.

17. The method of claim 10, wherein the aerosol provision device further includes a power source, the circuitry further includes a light source, and the setting identified by the processing circuitry is a power indicator mode of the light source that indicates a charge level or a status of a lifespan of the power source, and that is toggled by the processing circuitry between on an off.

18. The method of claim 10, wherein the setting identified by the processing circuitry is a lock mode of the aerosol provision device that is toggled by the processing circuitry between locked and unlocked.

19. The aerosol provision device of claim 1, wherein the electronic component within the article comprises a resistor.

20. The aerosol provision device of claim 19, wherein measuring, at the electrical connectors, the electrical resistance through an electrical component within the article, the article being engaged with the coupler or receptacle:

applying a voltage across the resistor for a duration; and measuring the voltage across and a current through the resistor.

* * * * *